United States Patent [19]

Ganev

[11] Patent Number: 4,458,859

[45] Date of Patent: Jul. 10, 1984

[54] COMBINED BOARDSAILER AND HANG GLIDER

[76] Inventor: Anton P. Ganev, 4241 S. 35th St., Arlington, Va. 22206

[21] Appl. No.: 486,889

[22] Filed: Apr. 20, 1983

[51] Int. Cl.[3] ..... B64C 31/02; B63H 9/04

[52] U.S. Cl. ..... 244/16; 244/105; 114/39; 114/90; 114/108; 441/74

[58] Field of Search ..... 114/39, 90, 102, 108; 441/74; 244/16, 38, 105, 106; 403/220

[56] References Cited

U.S. PATENT DOCUMENTS

| | | | |
|---|---|---|---|
| 1,823,096 | 9/1931 | Gilbert | 114/273 |
| 2,170,914 | 8/1939 | Rummler | 114/39 |
| 2,329,220 | 9/1943 | Rummler | 114/39 |
| 3,341,907 | 9/1967 | Michael | 114/108 |
| 3,393,535 | 7/1968 | Morin | 403/220 |
| 3,966,143 | 6/1976 | Smith | 114/39 |
| 4,077,345 | 3/1978 | Gurley | 114/102 |
| 4,365,570 | 12/1982 | Jamieson | 114/39 |
| 4,382,417 | 5/1983 | Talve | 114/102 |

FOREIGN PATENT DOCUMENTS

| | | | |
|---|---|---|---|
| 2833616 | 2/1980 | Fed. Rep. of Germany | 114/102 |
| 1484739 | 6/1967 | France | 114/39 |
| 2464181 | 3/1981 | France | 441/74 |

OTHER PUBLICATIONS

"Popular Science", Jul. 1963, p. 91, Picture and Subscript at Bottom of Page.

*Primary Examiner*—Trygve M. Blix
*Assistant Examiner*—Rodney Corl
*Attorney, Agent, or Firm*—Terry M. Gernstein

[57] ABSTRACT

A boardsailing device includes a sport converter which permits the boardsailing device to be converted into a hang glider. Essentially all of the power required for hang gliding is supplied by boardsailing, and the conversion from boardsailing to hang gliding is executed during boardsailing.

10 Claims, 7 Drawing Figures

COMBINED BOARDSAILER AND HANG GLIDER

BACKGROUND OF THE INVENTION

The present invention relates in general to sport devices, and, more particularly, to boardsailing devices.

The sport of boardsailing has become extremely popular, and has engendered many inventions such as those disclosed in U.S. Pat. Nos. 3,455,261, 3,742,886 and 3,858,542. However, all of the devices disclosed in the prior art are applicable only to boardsailing.

The sport of hang gliding has also become extremely popular, and has engendered many inventions as well. While hang gliding, unlike boardsailing, has been combined with other sports, such as water skiing, all of these combinations require motor driven means for providing motive power to the sportsman. Thus, all known hang gliding which begins in the water requires motor driven machinery, such as motor boats, or the like.

In boardsailing, the only motive power available is that power provided by the wind alone, and therefore, there is no known means for combining the sports of boardsailing and hang gliding, and these two popular sports have heretofore never been combined.

SUMMARY OF THE INVENTION

The device embodying the teachings of the present invention includes a sport converting means for converting a boardsailing device into a hang glider during boardsailing. All of the energy required to hang glide is gained during boardsailing. Thus, the hang glider is powered from the boardsailing process, and the sports of boardsailing and hang gliding can be combined.

The sport converting means includes a universal joint which connects a sail to a boardsailing main mast and a quick release catch which releasably connects the sail to either the main mast or to a tie line on the boardsailing board. The universal joint has means which can roll, pitch or yaw so the sail can execute corresponding movements.

To become airborne during boardsailing, the boardsailer operates the quick release catch to free the sail, and moves the sail from the boardsailing attitude into a hang gliding attitude. The user then hang glides until returning to the water, whereupon the sail is reanchored using the quick release catch, and boardsailing is continued.

OBJECT OF THE INVENTION

It is, therefore, the object of the present invention to combine the sports of boardsailing and hang gliding.

This together with other objects and advantages which will become subsequently apparent resides in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
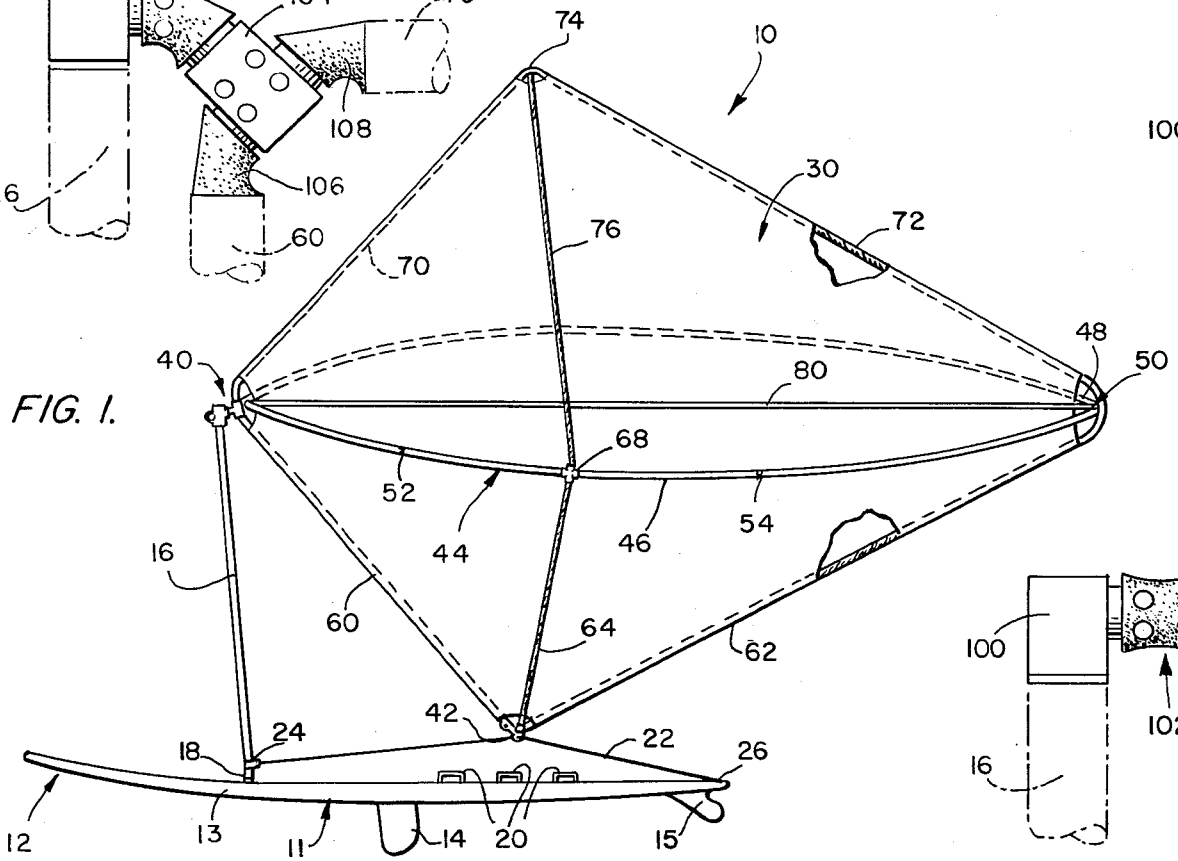
FIG. 1 is an elevation view showing the device embodying the teachings of the present invention in a boardsailing configuration.

Shown in FIG. 1 is a device 10 which combines boardsailing and hang gliding so a user can enjoy both sports simultaneously. The device 10 includes a boardsailing board 11 having a bow 12, a hull 13, a daggerboard 14 and a skeg 15. A main mast 16 is mounted forward of center of the board and is shorter than a standard boardsailing mast so the device 10 can be operated as a hang glider as well as a boardsailor. The mast 16 is mounted on the board by a universal bearing 18 so the mast can be tilted with respect to the board. Foot straps 20, or the like, receive a user's feet to secure the board to the user.

A flexible tie line 22 is fixed at one end thereof to the main mast by a coupling means 24 and at the other end thereof to the board stern 26. The tie line can be used to secure the board to a user and the function and operation thereof will be evident from the description presented hereinafter.

A sail 30 is attached to the main mast by a univeral joint 40 and to the tie line 22 or to the mast 16 by a quick release coupler 42. The sail 30 is shaped to function as either a hang glider sail when it is in the FIG. 5 configuration or as a boardsailor sail when it is in the FIG. 1 configuration. Accordingly, the rigging associated with the sail will also be selected so the sail can assume the appropriate configuration. In accordance with the boardsailing/hang gliding features of device 10, the sail 30 does not have a side which serves as a top per se and another side which serves as a bottom per se, but can sail or fly on either side thereof.

As shown in FIG. 1, a wishbone boom 44 has a port side boom 46 and a starboard side boom 48 each connected to the universal joint 40 at the forward ends thereof and connected together at the aft ends thereof by a coupling means 50 which can include an outhaul line to adjust the sail as required. Control of the sail is exercised by grasping the boom at suitable locations, such as locations 52 and 54 on port side boom 46. The boom 46 thus serves as a height and altitude control bar when the device is operating in the hang gliding mode. Descent of the hang glider is effected by pulling down on this bar at location 52, and ascent of the hang glider is effected by pulling down on the boom at location 54. The booms 46 and 48 are longer than booms generally used in boardsailing so the sail can be either a boardsailing sail or a hang gliding sail.

The rigging further includes a stiff bottom half mast 60 connected at one end thereof to the universal joint 40 and at the other end thereof to the coupler 42. A speed adjustment line 62 connects the coupler 42 to the coupler 50 and further lines, such as port side turn control line 64, connect the coupler 42 to the booms 46 and 48 by means such as steering adjuster 68. During hang gliding, the hang glider is turned by pulling on the turn control line 64 in the appropriate direction.

A stiff top half mast 70 is connected at one end thereof to the universal joint 40 and at the other end thereof to a speed adjustment line 72 by a coupling means 74. The line 72 is connected at the other end thereof to the coupler 50, and further lines, such as port side turn control line 76, connect the coupler 74 to the steering adjuster 68.

A line 80 is a sail/wing divider and serves to keep the sail 40 properly scooped during either boardsailing or hang gliding.

Those skilled in the art will understand how to shape and trim the sail and how to adjust the rigging to fulfill the above-mentioned functions of boardsailing and hang gliding based on the teaching of this disclosure. Accordingly, no further discussion thereof will be presented.

Figure 2:
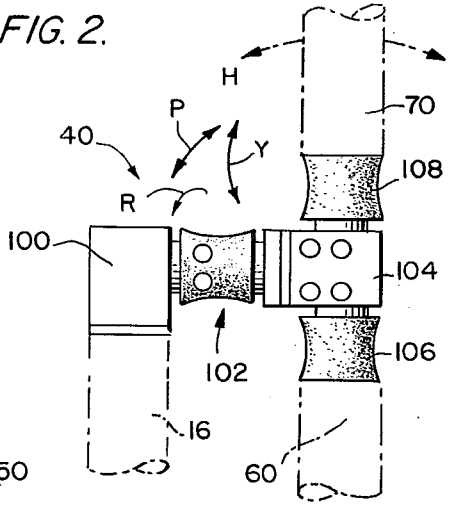
FIG. 2 is an elevation view of a preferred form of a universal joint used in the combined boardsailor-hang glider embodying the teachings of the present invention.

The preferred form of the universal joint 40 is shown in FIG. 2 and includes a cap 100 rotatably mounted on top of the mast 16 and having a flexible coupling joint 102 affixed thereto. The joint 102 can roll in direction R, pitch in direction P or yaw in direction Y so the sail can execute corresponding movements.

Figure 3A:
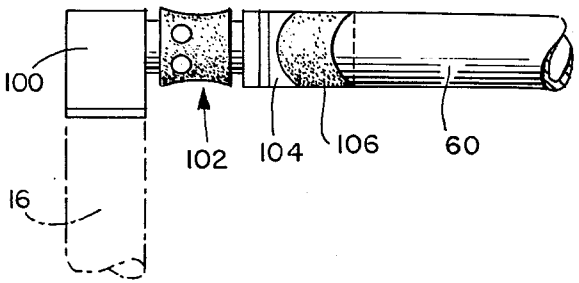
FIG. 3*a* is a schematic of a universal joint in the hang gliding configuration.
Figure 3B:
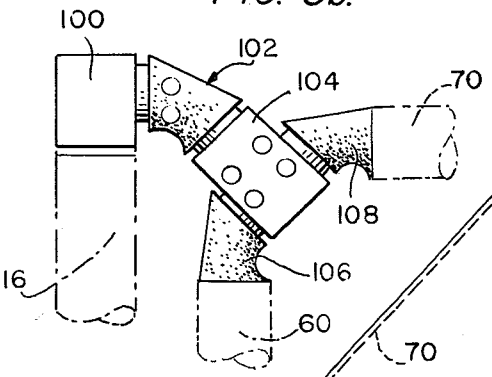
FIG. 3*b* is a schematic of a universal joint in the boardsailing configuration.

A flexible intermediate joint 104 is affixed to joint 102 to roll, pitch and/or yaw. Masts 60 and 70 are coupled to the joint 104 by flexible couplings 106 and 108, respectively, which can also move as required. In some cases, this movement can be roll, in others it can be pitch, and in still others it can be yaw, or a combination of such movements. Therefore, the same universal joint can be used for different sail shapes, depending on body weight and/or wind speed. The elements of the joint 40 can be rubber or some other material having flexibility and stiffness suitable to the aforementioned functions. The half masts move in direction H and can be coaxial as shown in FIG. 2 or angled with respect to each other as suitable. FIG. 3*a* illustrates the joint configuration for hang gliding and FIG. 3*b* illustrates the joint configuration for boardsailing.

Figure 4:
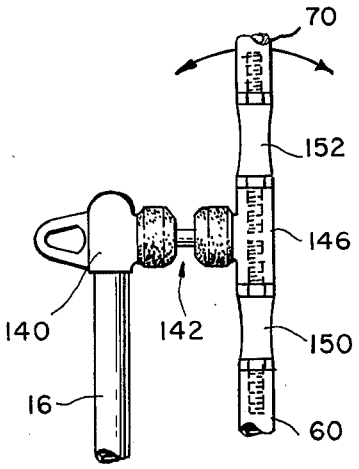
FIG. 4 is an elevation view of an alternative form of the universal joint used in the combined boardsailor hang glider embodying the teachings of the present invention.

An alternative form of the universal joint 40 is shown in FIG. 4 as including a cap 140 rotatably mounted on top of the main mast 16 and a connector joint 142 extending from the cap 140 aft thereof. The joint 142 can roll, pitch or yaw as could the joint 102, and is connected to a half mast connector element 146, which also can roll, pitch and/or yaw. Flexible connectors 150 and 152 connect the half mast connector to the half masts 60 and 70, respectively, and the half masts can move in direction H shown in FIG. 4.

Figure 6:
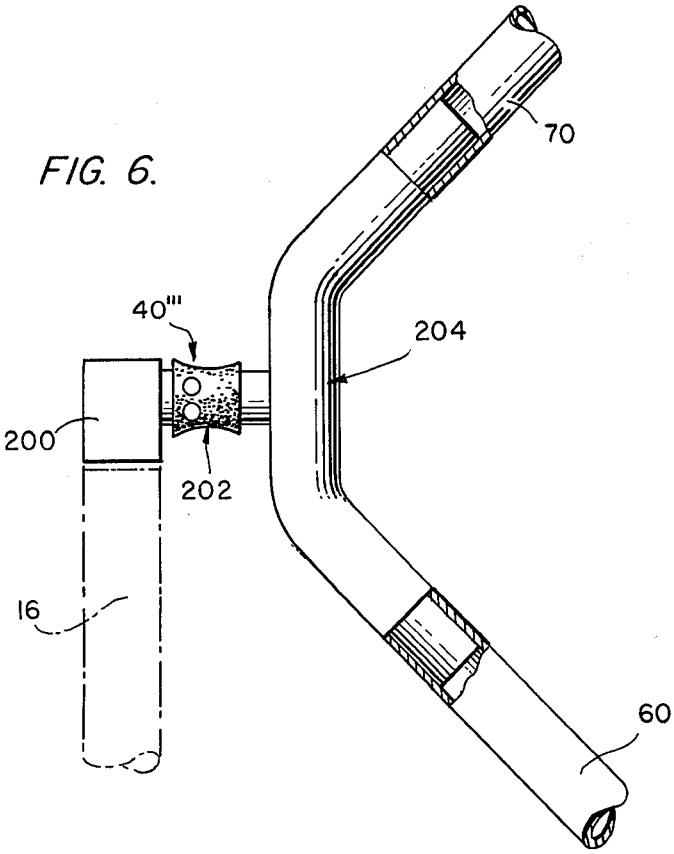
FIG. 6 is a side elevation view of a fixed angle universal joint used in the device embodying the teachings of the present invention.

A still further universal joint 40″ is shown in FIG. 6 as including a cap 200 rotatably mounted on top of the main mast 16 and a flexible connector joint 202. A rigid mast connector 204 connects half masts 60 and 70 together and to the joint 202 to be maintained at a fixed angle with respect to each other. The joint 40″ permits the half masts to move with respect to the main mast, but prevents movement of one half mast with respect to the other half mast.

Figure 5:
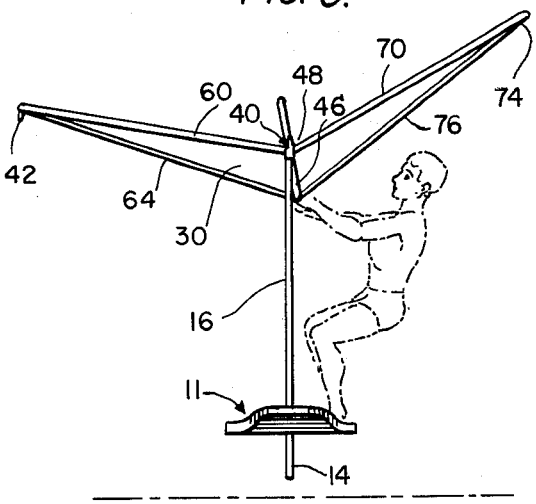
FIG. 5 is an elevation view of the device embodying the teachings of the present invention in a hang gliding configuration.

The flying configuration of the device 10 is shown in FIG. 5 and can be achieved during boardsailing by unhooking coupling means 42 and applying the proper pressure to the boom 46 or 48 and/or the control line 64. A boardsailing hang glide, as used herein, is a maneuver wherein a boardsailer becomes airborne after heading up-wind and releasing coupling 42. The motive power for the hang gliding is thus supplied exclusively by the power gained during boardsailing, and boardsailing becomes hang gliding. Based on the teaching of the present disclosure, those skilled in the art will be able to understand the requirements for the boardsailing operation and the boardsailing jump to properly execute the hang gliding operation. Accordingly, this procedure will not be further discussed.

In the flying configuration, the boardsailing boom 48 serves as a hang gliding king post, the boardsailing sail 30 serves as the hang gliding sail, the boardsailing half masts 60 and 70 serve as the hang glider leading edges, and the boardsailing boom 46 serves as a hang glider control bar. The boardsailing device is thus converted into a hang glider so a user can enjoy both sports simultaneously.

The sail 30 is connected to the board by the mast 16 and the operator, with the operator controlling the sail configuration to achieve the desired glide time and attitude.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A combined boardsailing and hang gliding device comprising:

a boardsailing board having an open upper deck surface on which a user stands for riding said board over water during boardsailing maneuvers and for riding said board during hang gliding maneuvers, and a lower surface for contacting the water and guiding said board through the water and altering direction of movement of said board through the water during boardsailing maneuvers, and means for permitting said board to execute boardsailing jumps;

a main mast mounted on said board upper deck surface and a boom movably attached to said main mast at a location to be grasped by a user for controlling said board during boardsailing maneuvers and during hang gliding maneuvers, said boom being movable from a boardsailing orientation into a hang gliding orientation with respect to said board;

a flexible, clothlike sail movably connected to said main mast and to said boom to be movable and configurable in a boardsailing orientation with respect to said board in which said sail is spread on said main mast and on said boom to catch and deflect wind to power and guide said board in a boardsailing mode and to be movable and configurable in a hang gliding orientation with respect to said board in which said sail is spread on said main mast and on said boom to lift, guide and support said board in a hang gliding mode with said board and a user pendently supported beneath said sail; and a sport converting means movably attaching said sail and said boom to said mast and to said board to be movable from a boardsailing orientation into a hang gliding orientation and from a hang gliding orientation into a boardsailing orientation, said sport converting means including a universal joint on said main mast attaching said sail and said boom to said main mast and having means permitting said sail and said boom to pitch, yaw and roll with respect to said main mast, and a quick release catch means on said sail for attaching said sail to said board during boardsailing maneuvers and for quickly detaching said sail from said board during a boardsailing jump for permitting said sail and said boom to be moved from a boardsailing orientation into a hang gliding orientation during said boardsailing jump to convert boardsailing momentum into hang gliding momentum with essentially all of the motive power required for hang gliding being supplied by boardsailing alone and for permitting said sail to be quickly re-attached to said board immediately after completion of a hang gliding maneuver to permit immediate resumption of boardsailing so that said sport converting means permits executing both boardsailing maneuvers and hang gliding maneuvers in rapid sequence using a single boardsailing board and boardsailing generated power alone.

2. The device defined in claim 1 wherein said main mast is shorter than a full boardsailing main mast.

3. The device defined in claim 1 wherein said sail includes first and second faces both of which can propel said boardsailing board during either boardsailing or hang gliding.

4. The device defined in claim 1 wherein said universal joint includes flexible portions.

5. The device defined in claim 1 wherein said sport converting means includes a line on said boardsailing board to which said quick release means is connected during boardsailing.

6. The device defined in claim 1 further including foot straps on said boardsailing board and a boom on said sail, a user, said foot straps, said boom, said main mast and said universal joint being the only means connecting said sail to said boardsailing board during hang gliding.

7. The device defined in claim 1 wherein said universal joint includes means for maintaining a fixed angle between half masts.

8. The device defined in claim 1 wherein said sail is polygonal to include a plurality of apices and is connected to said universal joint at a single apex thereof.

9. The device defined in claim 8 wherein said universal joint is located on top of said main mast.

10. The device defined in claim 8 wherein said quick release catch is located at another apex of said polygonal sail.

* * * * *